US008141704B2

(12) United States Patent
Ruhle

(10) Patent No.: US 8,141,704 B2
(45) Date of Patent: Mar. 27, 2012

(54) CONVERTIBLE GOLF CLUB CARRY BAG/GOLF CART BENCH MAT

(76) Inventor: Carol H. Ruhle, Pawleys Island, SC (US)

( * ) Notice: Subject to any disclaimer, the term of this patent is extended or adjusted under 35 U.S.C. 154(b) by 595 days.

(21) Appl. No.: 11/800,163

(22) Filed: May 4, 2007

(65) Prior Publication Data

US 2008/0272015 A1 Nov. 6, 2008

(51) Int. Cl.
*A63B 55/00* (2006.01)

(52) U.S. Cl. ..... 206/315.2; 206/315.3; 383/4

(58) Field of Classification Search ..... 206/315.2, 206/315.3; 383/4
See application file for complete search history.

(56) References Cited

U.S. PATENT DOCUMENTS 1,920,308 A * 8/1933 Hiles ..... 206/315.6
2,105,319 A * 1/1938 Hedden et al. ..... 190/1
2,442,105 A * 5/1948 Vacheron ..... 2/69.5
4,188,988 A * 2/1980 Agyagos ..... 383/4
4,301,920 A * 11/1981 Boggs ..... 206/315.1
4,518,198 A * 5/1985 Daniels ..... 297/229
4,886,150 A * 12/1989 Fitzsimmons ..... 190/1
4,934,833 A * 6/1990 Linder ..... 383/4
5,110,219 A * 5/1992 Lopes ..... 383/4
5,469,967 A * 11/1995 Boorady ..... 206/527
6,367,083 B1 * 4/2002 November ..... 2/69.5
6,966,439 B2 * 11/2005 Weleczki ..... 206/315.3
2005/0161483 A1 * 7/2005 Krohn et al. ..... 224/413

* cited by examiner

*Primary Examiner* — Tri Mai

(57) ABSTRACT

This invention is a convertible golf club carry bag/golf cart bench mat. The device is a single unit that is easily converted from a bag to a mat and vice versa. In a folded, zipped position it may be utilized as a golf club carry bag. In an unfolded, unzipped position it may be utilized as a mat to place on a golf cart bench seat for comfort. To add or remove clubs, the zippers are opened partially or fully to gain access to the clubs, according to the golfer's preference. The mat is held in place on a golf cart by unzipped side openings surrounding the cart railings.

3 Claims, 2 Drawing Sheets

CONVERTIBLE GOLF CLUB CARRY BAG/GOLF CART BENCH MAT

BACKGROUND OF THE INVENTION

The invention relates to a convertible golf club carry bag/golf cart bench mat that is comprised of a material that provides adequate substance and strength for carrying golf clubs. More specifically, the invention relates to a one-piece device that can be fully opened to be placed on a standard golf cart bench seat or folded in half lengthwise, and closed on the remaining three sides to create a long narrow bag suitable for carrying golf clubs.

Typically, a golfer will carry a few clubs to a practice range or to a golf course for walking a round of golf, but may not want to be burdened with lugging a full size bag. Rather than carrying several clubs loosely or using a bulkier, heavier bag, a golfer may transport or store his/her clubs in this golf club carry bag. When the clubs are removed from this convertible golf club carry bag, this bag may be unzipped to convert it into a golf cart bench mat that may be placed on the golf cart bench seat for comfort.

Also, many golfers keep several clubs in their cars either in a bulky golf bag or loose in the car trunk in order to practice or play golf. This golf club carry bag will provide a simple compact place to store these clubs neatly in order to be ready to take them to the practice range or carry on a golf course.

Golf cart bench seats are typically made of a vinyl fabric, which can be hot and sticky in the summer and cold in the winter months. The preferred embodiment of the present invention is made of a breathable, absorbent fabric that provides comfortable seating in any temperature. Optionally, side pockets or other attachments may be added for the convenience of holding related golf or personal items such as tees, balls, cell phone and keys.

There are patents in existence for golf cart mats. There are patents for golf club bags. There are patents for combination bags for toting items to the beach. However, there are no known patents for a convertible golf club carry bag/golf cart bench mat that is for the specific combined purpose of use as either a golf club carry bag or a golf cart bench mat.

BRIEF SUMMARY OF THE INVENTION

The principal object of this invention is to-provide a lightweight protective carry bag for golf clubs that can be easily converted into a golf cart bench mat and vice versa. The mat is secured on the cart via embedded openings and side sections of mat that respectively surround each side rail-and hang a short way down the side edge of the golf cart bench. The mat can be further secured to the side rails via a connecting mechanism, such as hook and loop tape. The golf club carry bag is fully enclosed with a perimeter fastening mechanism, such as a zipper or a plurality of zippers, which allows flexible access to the clubs inside the golf club carry bag.

It is an object of the invention to provide a lightweight protective carry bag for golf clubs.

It is an object of this invention to provide a golf club carry bag that is easy to use.

It is an object of the invention to be able to quickly and easily convert this golf club carry bag into a comfortable mat to be placed on the golf cart bench seat during a round of golf in which a cart is used.

It is an object of the invention to function as a golf club travel bag

It is an object of the invention to hold a selection of golf clubs to be used in lieu of a larger bulkier golf bag.

It is an object of this invention to be a device that is of a simple construction.

It is an object of this invention to provide a convertible golf club carry bag and golf cart bench mat that may be ornamentally geared to special holiday colors or according to a golfer's color scheme.

It is an object of the invention to easily change a golf cart bench mat into a golf club carry bag in order to carry several clubs from a golf cart to the ball, which may be a long distance from the cart, so the proper club selection is not known.

It is an object of the invention for the golf cart bench mat to fit most standard golf carts that have a bench seat.

BRIEF DESCRIPTION OF THE DRAWINGS

There are three drawings to show the invention as follows.

DETAILED DESCRIPTION OF THE INVENTION

Figure 1:
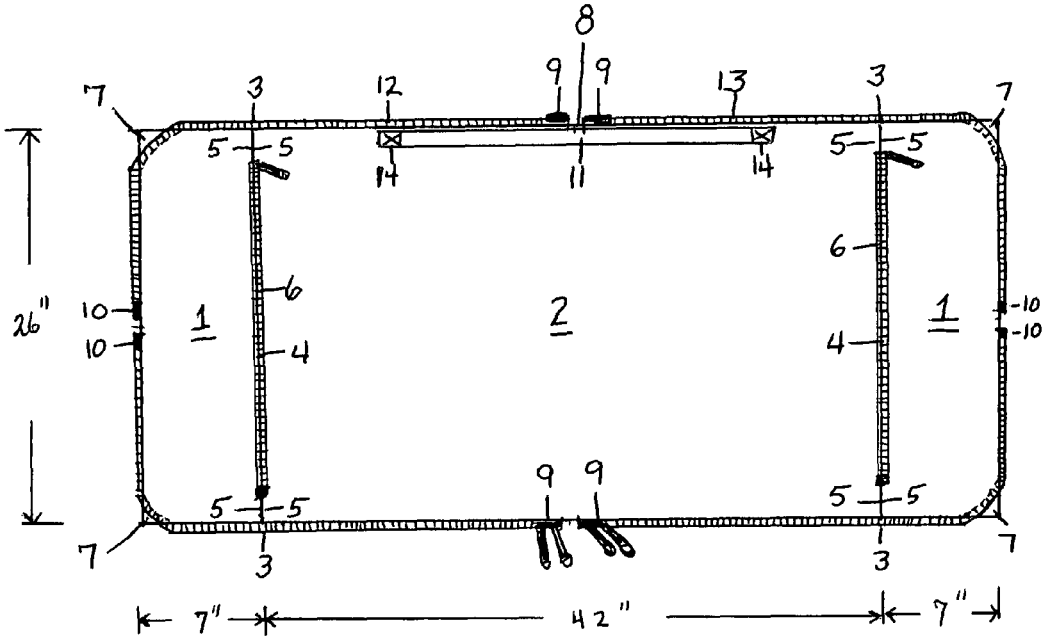
FIG. 1 shows the invention opened as an essentially flat mat in order to describe the construction of one embodiment of the invention.

Refer to FIG. 1, which is a drawing of the invention opened as an essentially flat mat. This drawing will be used for describing the construction of one embodiment of the invention. The preferred embodiment, comprised of three substantially rectangular sections, side sections 1 and main section 2, is constructed of quilted fabric. The main section 2 is measured to fit most standard golf cart bench seats plus a few inches that allow the mat to hang over the front of the cart bench seat. Each of the side sections 1 measures eight inches wide and has the same depth as the main section 2. The side sections 1 are connected to main section 2 by short two-inch seams 5 sewn from each edge 3, leaving parallel openings 6. A zipper 4 is sewn into each opening 6 between these seams 5. In this embodiment, corners 7 are rounded (cut off) for ease in installing the zippers 12 and 13 on perimeter 8. These two-way separating zippers 12 and 13 are sewn to the perimeter 8, such that said zippers 12 and 13 are on opposite side sections 1. In this embodiment, bottom ends 9 of each zipper 12 and 13 are placed near the center of the wide edge of the main section 2 and the top ends 10 of each zipper 12 and 13 are placed a half inch from the center of the short edge of the side sections 1. The placement of the zippers 12 and 13 is such that when the device is folded in half lengthwise, the corresponding zipper halves meet. A strap handle 11 of the desired length is centered on the main section 2 close to either edge 3, but not covering the zippers 12 and 13. The strap handle ends 14 are sewn securely to the main section 2.

Figure 2:
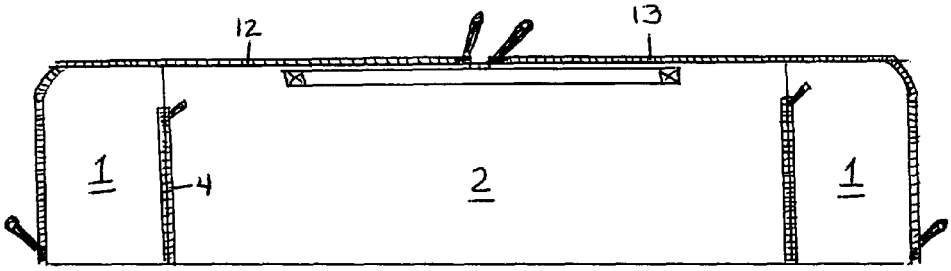
FIG. 2 shows the invention as converted into a golf club carry bag.

Refer to FIG. 2, which is a drawing of the convertible golf club carry bag/golf cart bench mat folded in half forming a golf club carry bag. The inner zippers 4 and the outer two-way separating zippers 12 and 13 are zipped closed forming the golf club carry bag.

Figure 3:
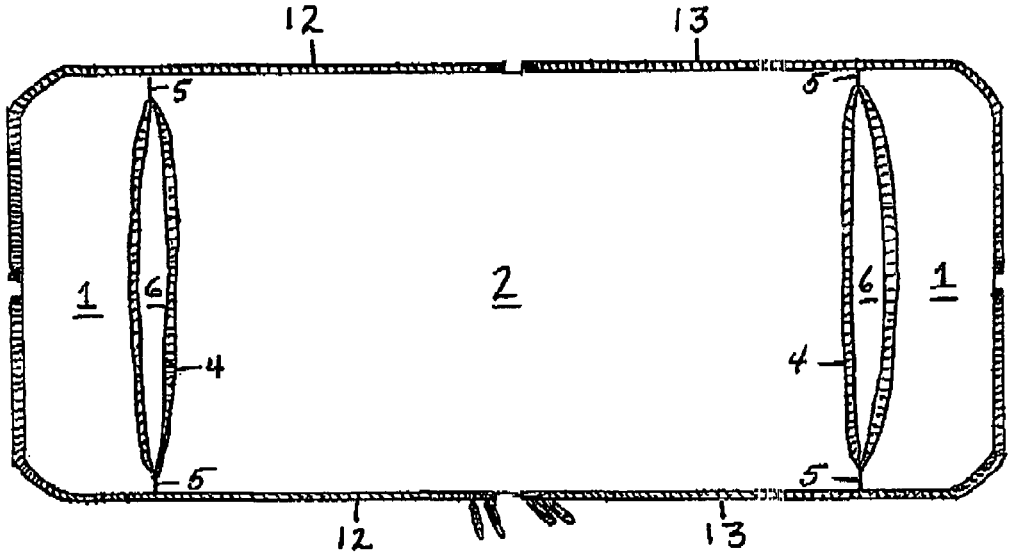
FIG. 3 shows the invention as converted into a golf cart bench mat with embedded openings that can be placed around the rails of a standard golf cart bench seat.

Refer to FIG. 3, which is a drawing of the invention as golf cart bench mat with the seam openings 6 that can be placed around the side rails of a standard golf cart bench seat. This drawing intentionally does not show a golf cart bench seat, but note that the side rails on a standard golf cart bench seat are situated at the side edges of a standard golf cart bench seat. The two-way separating zippers 12 and 13 on perimeter 8 are unzipped and the device is unfolded creating an essentially flat mat. The zippers 4 that are embedded in the seams 5 are unzipped creating openings 6 that can be placed around the golf cart side rails such that the main section 2 is positioned on the sitting surface (under main section 2) of the golf cart bench. The side sections 1 extend a few inches beyond the sides of the sitting surface. The front edge of the main section 2 can extend a few inches beyond the front edge of the sitting surface.

The drawings and description details are intended to be representative of the embodiments that may be created for this invention. The fabric of the preferred embodiment is a three-layered quilted fabric with a batting as the middle layer. Said quilted fabric provides substance for carrying golf clubs and for sitting comfort. This construction may be varied such as using thin foam as the middle layer. The size may vary according to the dimensions of the golf cart bench seat and the length of the longest club to be carried. The device may contain pockets for carrying balls or other items. The side sections may be embellished such as with tee holders, pockets, and rings for holding various items, such as a golf glove or keys. In addition, hook and loop tape or other type of connecting mechanism may be added to further secure the golf cart bench mat so it will not blow off in windy conditions. The strap, i.e., handle arrangement, may be varied as well, for example to allow the golf club carry bag to be carried as a backpack.

While the device has been particularly shown and described with respect to the illustrated design and preferred embodiment, it will be understood by those skilled in the art that omissions, substitutions, and changes in forms and details of the device illustrated may be made without departing from the spirit and scope of the invention.

What is claimed:

1. A device for carrying golf clubs that converts into a mat to place on a standard golf cart bench seat and vice versa, comprising, a. a single unit in substantially rectangular shape, having a front, back and two side edges;

b. a zippered outer edge that when joined forms the outer edge of a bag said bag having a fold line forming one edge of said bag, and when said zippered outer edge being separated forming a flat mat;

c. two seams; each said seam is indented from opposite side edges; each said seam is sewn at each end; each said seam contains an embedded zipper going through said fold line; each said zipper is zipped closed when the invention forms a bag; each said zipper is unzipped, forming an opening, when the invention forms a mat; each said opening is placed around the side rails of the golf cart.

2. A device as in claim 1 for a golf cart bench seat mat that converts into a bag for carrying golf clubs.

3. A device as in claim 1, in which the material is made of a single fabric or multiple fabric layers to provide and adequate strength for carrying golf clubs.

* * * * *